United States Patent [19]

Dechelette

[11] Patent Number: 4,878,858

[45] Date of Patent: Nov. 7, 1989

[54] LOW PROFILE SHIELDED JACK

[75] Inventor: Helen M. P. Dechelette, Paris, France

[73] Assignee: Molex Incorporated, Lisle, Ill.

[21] Appl. No.: 283,670

[22] Filed: Dec. 13, 1988

[51] Int. Cl.[4] ..... H01R 13/648

[52] U.S. Cl. ..... 439/607; 439/680; 439/108

[58] Field of Search ..... 439/92, 101, 108, 607, 439/608, 609, 610, 680, 676

[56] References Cited

U.S. PATENT DOCUMENTS

| | | | |
|---|---|---|---|
| 4,552,423 | 11/1985 | Swengel, Jr. | 439/607 X |
| 4,571,012 | 2/1986 | Bassler et al. | 439/607 X |
| 4,603,936 | 8/1986 | Jagen | 439/610 X |
| 4,637,669 | 1/1987 | Tajima | 439/100 X |
| 4,679,879 | 7/1987 | Triner et al. | 439/425 |

*Primary Examiner*—Neil Abrams
*Assistant Examiner*—Khiem Nguyen
*Attorney, Agent, or Firm*—Louis A. Hecht; Stephen Z. Weiss

[57] ABSTRACT

A low profile shielded jack is provided with a shield disposed substantially entirely within the nonconductive housing of the jack. The shield comprises a plurality of peripheral walls dimensioned to closely engage the internal walls of the plug receiving cavity in the jack housing. The peripheral walls include a plurality of inwardly extending spring contacts for electrically engaging the shield on a plug. The shield further comprises board contact structures for extending into electrical contact with a ground on the board. The housing of the jack is provided with slots for receiving the board contact structures of the shield. The slots are disposed to enable the shield to be slidably inserted into the plug receiving cavity from the mating face of the jack.

14 Claims, 6 Drawing Sheets

LOW PROFILE SHIELDED JACK

BACKGROUND OF THE INVENTION

Jacks define female electrical connectors having a nonconductive housing and electrically conductive terminals therein. The jack typically is mounted to a circuit board, panel or the like, with the terminals in the jack being electrically connected to conductive areas on the circuit board or panel. The jack is mateable with a male plug connector which also has a nonconductive housing and a corresponding number of electrically conductive terminals. The plug frequently will be mounted to a cable having a plurality of electrically conductive leads which are respectively connected to the terminals in the plug. The cable leading to the plug may define a round cable or a flat flexible cable depending upon the particular application.

The combination of jacks and mateable plugs are used in many electrical devices, with broad applications being found in computers and telecommunications equipment. In most such applications it is necessary to shield signal carrying circuits to avoid generating electromagnetic interference (EMI), and/or to avoid being impacted by ambient EMI. In particular, the signal carrying cables leading to the above described plug typically will comprise an electrically conductive shield, such as a braid or a foil, extending around the signal carrying conductors of the cable. The plug to which the cable is connected also will comprise an electrically conductive shield extending thereabout and in electrical contact with the shield of the cable.

The jack will include its own shield which will be grounded to the board on which the jack is mounted. The typical shield for the prior art jack is mounted to the exterior of the jack housing, and comprises solder tails or other such board contact means unitary therewith and disposed to be electrically connected to grounds on the board. The shield of the prior art jack comprises contact means extending into the plug receiving cavity of the prior art jack. The contact means of the shield for the prior art jack are disposed to electrically contact the shield of the above described plug.

The prior art includes many variations to the above described shielded jacks. For example, many prior art jacks dispose the shields primarily on the front mating face of the jack with spring fingers extending into the plug receiving cavity of the jack for electrical grounding connection to the shield on the plug inserted into the plug receiving cavity of the jack. The grounding connection between the shielded jack and the board on which the jack is mounted is generally achieved by solder tails or other such board grounding contact means extending from the external portion of the prior art shield. An example of such a prior art shield is shown, for example, in U.S. Pat. No. 4,493,525 which issued to Hall et al. on Jan. 15, 1985.

Many shielded jacks include both internal and external shields. For example, an internal shield may substantially surround the terminals in the jack housing, while an external shield may surround at least portions of the external surfaces of the jack housing. A prior art shielded jack of this general type is shown in U.S. Pat. No. 4,637,669 which issued to Tajima on Jan. 20, 1987. The internal and external shields shown in U.S. Pat. No. 4,637,669 are electrically connected to one another and are then grounded to the board.

It is believed that in many of the prior art shielded jack constructions, the interconnected internal and external shields and/or the large grounding structures on the front mating face of the jack may actually function as antennas that can exacerbate EMI problems.

Electrical components have undergone remarkable miniaturization in recent years. As a result of this ongoing miniaturization, the density of circuits and components mounted to a circuit board has increased dramatically. This continuing trend toward component miniaturization and greater circuit density has created a very substantial demand for electrical connectors that achieve a lower profile and/or that occupy a smaller surface area or "footprint" on the board. Even small reductions in a connector's profile or footprint generally are greeted with significant commercial success. Particularly desirable connectors are those that can provide a lower profile or a smaller footprint while still being mateable with an accepted and standarized electrical connector plug.

It is also well known that the electrical connector industry is extremely competitive and cost conscious. Connectors that can achieve a specified function at a slightly lower cost can be particularly advantageous.

Accordingly, it is an object of the subject invention to provide a low profiled shield for an electrical connector jack.

It is another object of the subject invention to provide a low profile shielded jack.

It is an additional object of the subject invention to provide an EMI shield and a corresponding shielded jack that can be manufactured with substantially less metal and that achieve corresponding cost advantages.

A further object of the subject invention is to provide a low cost, low profile shielded jack that can be employed with a specified footprint on a circuit board.

An additional object of the subject invention is to provide a low profile shielded jack that is mateable with a standardized shielded plug connector.

Still a further object of the subject invention is to provide a shielded jack wherein substantially all of the shielding is disposed at interior locations on the jack.

Yet another object of the subject invention is to provide a shielded electrical connector wherein the components are easy to manufacture and to assemble.

SUMMARY OF THE INVENTION

The subject invention is directed to a shielded jack having a nonconductive housing formed to define a plug receiving cavity extending into the mating face of the jack. Terminals are disposed in the housing to make electrical contact with corresponding terminals on a prior art plug urged into the plug receiving cavity of the subject jack.

As noted above, the plug is typically mounted to a round or flat flexible cable which has an EMI shield, such as a braid or foil extending therealong. The EMI shield of the cable is electrically connected to a shield around the prior art plug with which the subject jack is mateable. At least a portion of the EMI shield on the plug is disposed at external locations thereon for electrical connection to a corresponding shield on the jack with which the shielded plug is mated.

The jack of the subject invention includes a shield disposed substantially within the plug receiving cavity of the housing. The shield may be stamped and formed from a unitary blank of electrically conductive material. In particular, the shield may be stamped and formed such that peripheral shield walls substantially conform to the internal periphery of the plug receiving cavity in the jack housing. The shield may comprise a plurality of inwardly directed spring contacts which are stamped unitarily from the peripheral shield walls disposed within the plug receiving cavity, and which electrically contact the corresponding shield on the plug. The spring contacts may be biased inwardly a sufficient amount to require deflection upon insertion of the plug into the plug receiving cavity of the jack. Thus, a high contact force may be ensured between the internal shield of the jack and the external shield of the plug. It will be appreciated that the above described construction is in significant contrast to the prior art EMI shields where significant portions of the shield were external on the jack housing and wherein contacts were bent around the front mating face of the jack and into the plug receiving cavity.

The shield and the jack housing of the subject invention may be constructed to comprise means for controlling the amount of movement of the shield into the housing, to ensure that the spring contacts of the shield on the jack will properly align with the external shield on the plug. For example, the jack housing may comprise a ledge or other such stop means against which the internal shield of the jack may be urged to define the maximum amount of insertion. Similarly, the shields and the jack housing may comprise means for locking the shield into its selected position in the housing. The locking means may comprise teeth which define an interference fit between the shield and the jack housing.

The internal disposition of the shield further enables the shield to be provided with key means for ensuring that only selected plugs may be mated therewith. The key means may comprise one or more key tabs which may be formed to extend into the plug receiving cavity on selected jacks. The number and selection of key tabs extending into the plug receiving cavity may be selected to correspond to a pattern of key tab receiving means, such as grooves, on certain plugs that may be employed with the jack.

The shield further comprises board contact means extending therefrom. In particular, the board contact means may comprise solder tails formed unitarily with the shield and disposed to extend into electrical connection with an electrically conductive ground on the circuit board. The jack housing may comprise slots extending into the front mating face of the housing for receiving the board contact means of the shield. The slots, therefore, will enable the shield and the board contact means thereof to be readily slidably inserted into the jack housing from the front mating face thereof. The slots in the jack housing may extend into the side walls of the housing generally adjacent the bottom wall of the housing which will be disposed generally in face to face contact with the circuit board. This disposition of the slots in the jack housing and the board contact means of the shield will enable the shielded jack to be employed on a circuit board having a specified footprint established for the prior art jacks which employ an external shield. However, the shield of the subject invention will be internally disposed thereby ensuring a lower profile for the jack and enabling a substantially smaller amount of conductive material to be employed in manufacturing the shield as explained further below. In other embodiments, the board contact means may extend directly through the bottom wall of the jack housing thereby achieving both a lower profile and a smaller footprint for the jack.

DETAILED DESCRIPTION OF THE PREFERRED EMBODIMENTS

Figure 1:
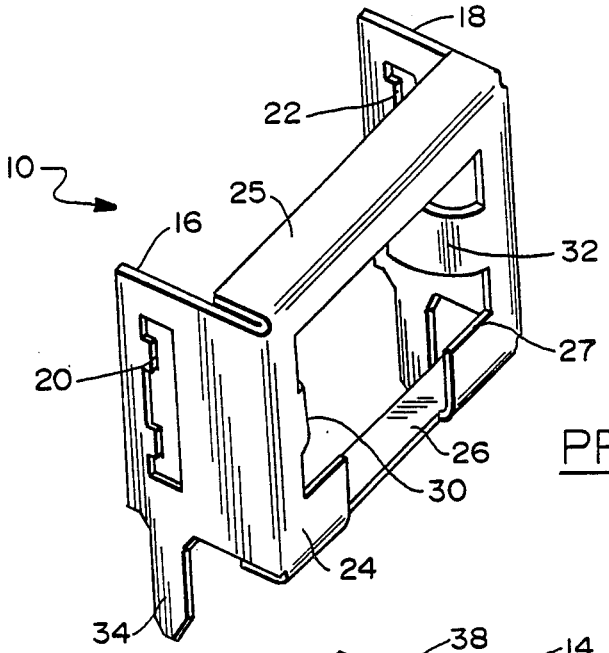
FIG. 1 PRIOR ART
FIG. 1 is a perspective view of a prior art EMI shield for mounting to a board mountable jack.
Figure 2:
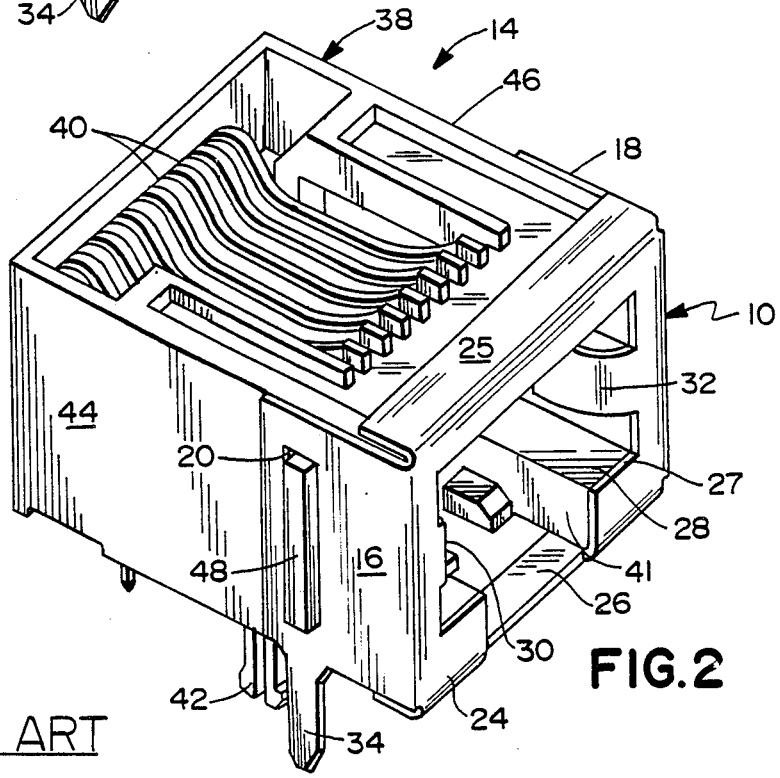
FIG. 2 PRIOR ART
FIG. 2 is a perspective view of a prior art shielded board mountable jack employing the external shield depicted in FIG. 1.

A prior art EMI shield 10 for external mounting on a board-mountable right angle jack 12 is illustrated in FIGS. 1 and 2. The prior art shield 10 is formed from a stamped blank of metallic material identified generally by the numeral 14 in FIG. 3. The prior art shield 10 includes opposed side walls 16 and 18 having mounting apertures 20 and 22 respectively stamped therethrough. The side walls extend unitarily from and orthogonal to a front wall 24 of the prior art shield 10. A top wall 25 and a bottom wall 26 also extend unitarily from the front wall 24 of the prior art shield 10 and are orthogonal to the front wall 24 and to both side walls 16 and 18.

Figure 3:
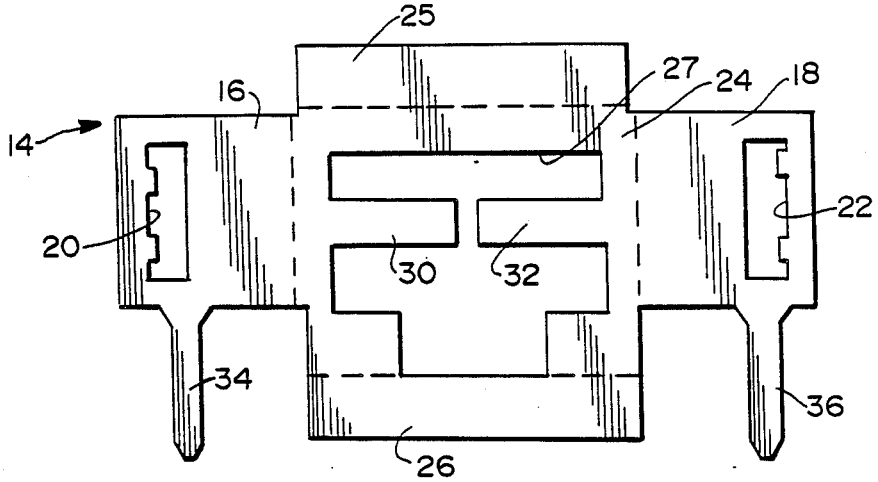
FIG.3 PRIOR ART
FIG. 3 is a top plan view of a stamped sheet of metal material for forming the prior art shield depicted in FIG. 1.

The front wall 24 of the prior art shield 10 is stamped to define a plug receiving aperture 27 therethrough for alignment generally with the plug receiving cavity 28 of the jack 12. The prior art shield 10 further comprises spring contacts 30 and 32 which extend unitarily from opposed sides of the front wall 24. The spring contacts 30 and 32 of the prior art shield 10 are disposed to extend into the plug receiving cavity 28 of the prior art jack 12. The prior art shield 10 further comprises solder tails 34 and 36 which extend unitarily from the side walls 16 and 18 respectively and generally in the same plane thereof. The solder tails 34 and 36 are disposed to extend into through holes in the circuit board (not shown) to which the prior art jack 12 is mountable. The solder tails 34 and 36 will then be electrically connected to an appropriate ground on the circuit board. The stamped blank of metal material 14 from which the shield 10 is formed is shown in FIG. 3, with the above referenced portions of the shield 10 being identified by identical numbers on the blank 14.

With reference to FIG. 2, the prior art jack 12 comprises a nonconductive housing 38 having a plurality of electrically conductive terminals 40 mounted therein. The nonconductive housing 38 of the prior art jack 12 includes a bottom wall 41 having locking means 42 extending therefrom. The bottom wall 41 of the housing 38 is mountable in generally opposed relationship to the printed circuit board, with the locking means 42 thereof being securely engaged in an appropriate aperture on the printed circuit board.

The housing 38 of the prior art jack 12 comprises side walls 44 and 46 having locking tabs 48 extending outwardly therefrom. The prior art shield 10 is mountable to the prior art housing 38 such that the side walls 16 and 18 of the prior art shield 10 are external to and generally in face to face relationship with the side walls 44 and 46 respectively of the prior art housing 38. More particularly, the aperture 20 extending through the side walls 16 of the prior art shield 10 will lockingly engage the outwardly extending tab 48 on the side wall 44 of the prior art housing 38. In a similar manner, although not shown in FIG. 2, the aperture 22 on the side wall 18 of the prior art shield 10 will lockingly engage the outwardly extending tab on the side wall 46 of the prior art housing 38. The locking engagement of the side walls 16 and 18 of the prior art shield 10 with the side walls 44 and 46 of the prior art housing 38 will position the front wall 24 of the prior art shield 10 adjacent the front mating face of the prior art housing 38. In this disposition, the top and bottom walls 25 and 26 of the prior art shield 10 will be disposed externally on corresponding front and bottom portions of the prior art housing 38. Additionally, the spring contacts 30 and 32 will extend into the plug receiving cavity 28 of the prior art jack 12.

Figure 4:
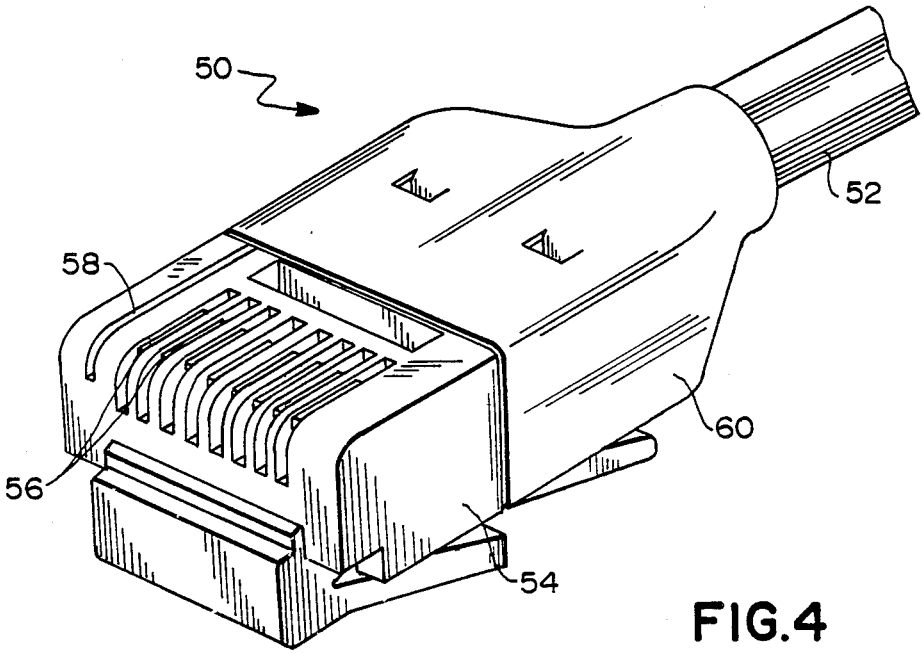
FIG. 4 is a perspective view of a prior art shielded plug.

A prior art standardized plug for use with the prior art jack 12 is depicted in FIG. 4 and indicated generally by the numeral 50. The prior art plug 50 is mounted to a shielded cable 52 which is depicted in FIG. 4 as being round. However, it will be understood that other versions of prior art plugs employ flat flexible cables. The prior art plug 50 includes a nonconductive housing 54 having a plurality of plug contacts 56 securely mounted therein. The housing 54 is dimensioned to be placed into the plug receiving cavity 28 of the prior art jack 12 depicted in FIG. 2, such that the plug contacts 56 will engage their respective terminals 40 in the prior art jack 12. The housing 54 further comprises a keying groove 58 which may be engaged with a corresponding key structure (not shown) on the prior art jack 12 of FIG. 2. The keying groove 58 may be disposed in different locations on different prior art plugs 50 to ensure that the prior art plug 50 is mated with the appropriate prior art jack 12. The prior art plug 50 depicted in FIG. 4 further comprises an external metallic shield 60 which is in electrical contact with the shield of the cable 52. The spring fingers 30 and 32 of the prior art shield 10 on the prior art jack 12 depicted in FIG. 2 will electrically engage the shield 60 on the prior art plug 50, and will enable a ground to the board on which the prior art jack 12 is mounted through the solder tails 34 and 36 of the prior art shield 10.

With reference to FIG. 2, it will be noted that the external disposition of the prior art shield 10 results in an enlargement of the profile required for the prior art jack 12. Additionally, the tabs 48 extending from the side walls 44 and 46 of the prior art jack 12 to enable locking engagement of the prior art external shield 10 further add to the profile required for the prior art jack 12. As noted above, the profile required for the prior art jack 12 controls the location of adjacent circuit components and the location of adjacent boards in an electrical apparatus. It is extremely desirable to reduce the profile and/or the footprint if possible to enable greater circuit density in an electronic apparatus.

Figure 5:
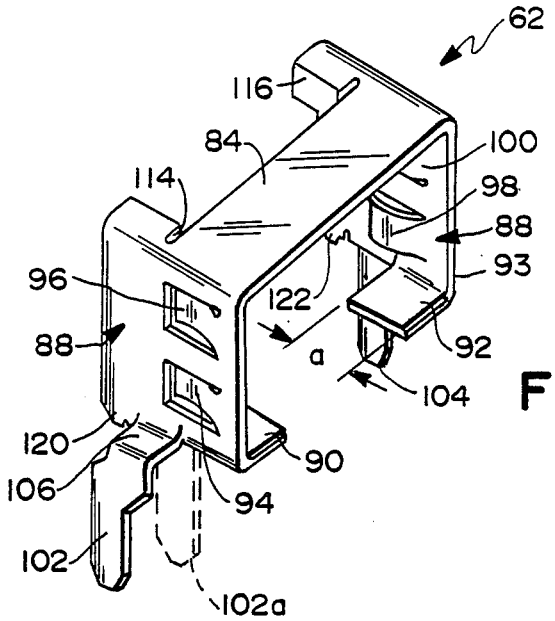
FIG. 5 is a perspective view of the EMI shield in accordance with the subject invention.
Figure 7:
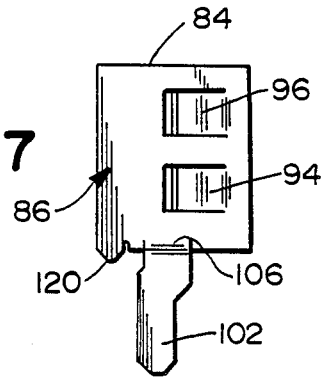
FIG. 7 is a side elevational view of the shield of FIG. 5.
Figure 6:
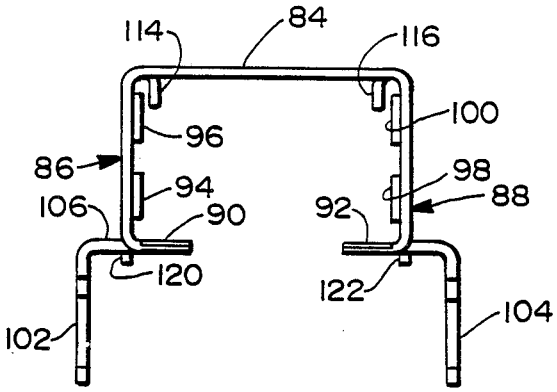
FIG. 6 is a front elevational view of the shield of FIG. 5.

The shield of the subject invention is indicated generally by the numeral 62 in FIGS. 5–7. The shield 62 is formed from a unitarily stamped blank 64 depicted in FIG. 8. The blank 64 for forming the shield 62 of the subject invention is drawn to the same general scale as the prior art blank 14 depicted in FIG. 3. As will be explained herein, the blank 64 enables the equivalent shielding to be achieved with approximately a 44% reduction in material as compared to the prior art blank 14 of FIG. 3, while also enabling a lower profile and a smaller footprint if desired.

Figure 9:
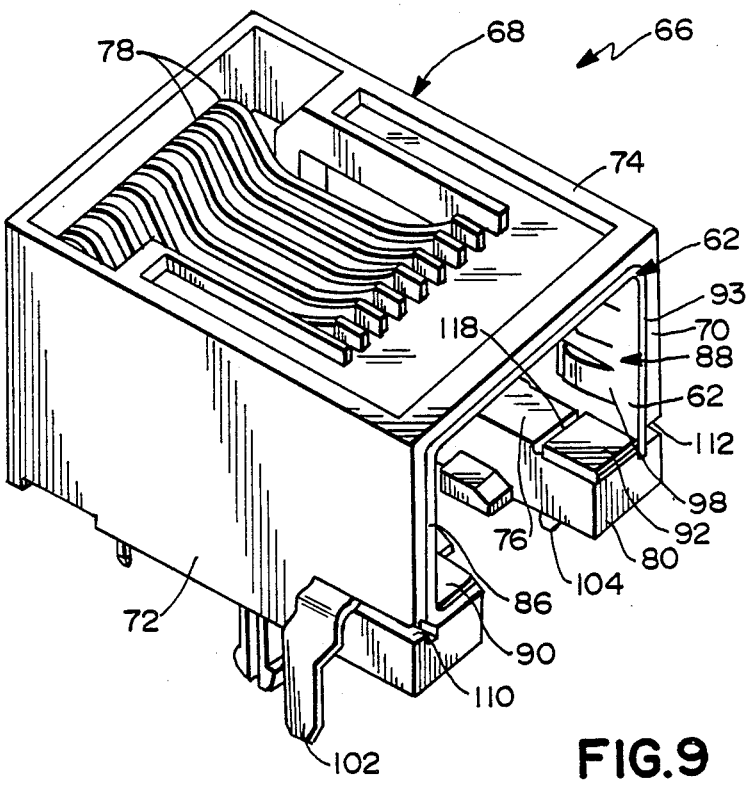
FIG. 9 is a perspective view of the shielded jack in accordance with the subject invention.
Figure 10:
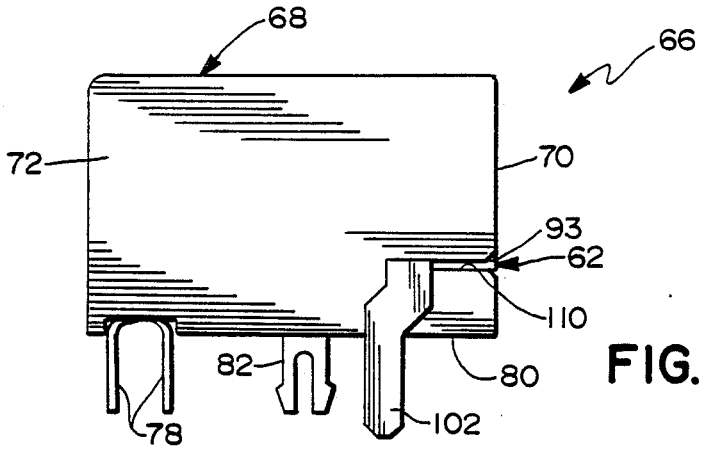
FIG. 10 is a side elevational view of the shielded jack shown in FIG. 9.

The shield 62 is formed for mounting in a right angled jack 66 depicted in FIGS. 9 and 10. The jack 66 includes a molded nonconductive housing 68 having a front mating face 70, a pair of opposed side walls 72 and 74 and a plug receiving cavity 76 extending into the front mating face 70 thereof. A plurality of electrically conductive terminals 78 are mounted in the housing 68 of the right angled jack 66 and extend into the plug receiving cavity 76 thereof. The jack 66 is constructed to mate with the prior art plug 50 described above and illustrated in FIG. 4. More particularly, the prior art plug 50 described above is insertable into the plug receiving cavity 76 of the jack 66 such that the plug contacts 56 of the prior art plug 50 will electrically contact the respective terminals 78 mounted in the right angled jack 66. The jack 66 further comprises a bottom wall 80 having board engagement means 82 extending therefrom. The bottom wall 80 is disposed for mounting in opposed relationship to a circuit board (not shown). The circuit board will comprise an aperture means extending therethrough which will lockingly receive the board engagement means 82 of the jack 66.

Returning to FIGS. 5–7, the shield 62 is unitarily formed from the stamped blank 64 to define a top wall 84 and a pair of opposed parallel side walls 86 and 88 extending orthogonally from the top wall 84. Bottom walls 90 and 92 extend unitarily from the respective side walls 86 and 88. The bottom walls 90 and 92 extend toward one another generally in the same plane with one another and substantially parallel to the top wall 84. The external dimensions defined by the top wall 84, the side walls 86 and 88 and the bottom walls 90 and 92 are selected to enable the shield 62 to be slid into the plug receiving cavity 76 of the housing 68 in the jack 66 as illustrated most clearly in FIG. 9. Additionally, the length of the top wall 84, side walls 86 and 88 and bottom walls 90 and 92 is such that the mating end 93 of the shield 62 is aligned with the mating face 70 of the housing 68.

The shield 62, as shown in FIG. 5, includes spring contacts 94-100 extending inwardly therefrom. In particular, spring contacts 94 and 96 are stamped and formed to extend inwardly from the side wall 86, while spring contacts 98 and 100 are stamped and formed to extend inwardly from the side wall 88. It will be appreciated that the number and disposition of the spring contacts 94-100 may vary from that shown herein, and will be determined at least in part by the particular configuration of the plug to be employed with the jack 66. In some embodiments, for example, spring contacts may be formed in the top wall 84 or the bottom walls 90 and 92. The spring contacts 94-100 extend a sufficient distance inwardly to engage the shield 60 on the prior art plug 50 upon insertion of the prior art plug 50 into the plug receiving cavity 76 of the jack 66 shown in FIG. 9. More particularly, the insertion of the prior art plug 50 into the jack 66 will achieve a wiping electrical contact between the shield 60 and the spring fingers 94-100. Furthermore, the spring contacts 94-100 will be deflected outwardly by the shield 60 of the prior art plug 50 to achieve a specified contact force against the shield 60.

The shield 62 further comprises solder tails 102 and 104 extending unitarily from the side walls 86 and 88 respectively. The solder tails 102 and 104 are formed to align with through holes in the printed circuit board to which the jack 66 is mountable. As depicted in FIGS. 5–7, the solder tails 102 and 104 include outwardly extending connecting portions 106 and 108 which are disposed generally in the same plane as the bottom walls 90 and 92. The housing 68 is provided with a pair of slots 110 and 112 extending respectively through the side walls 72 and 74 thereof generally adjacent the lower most portion of the plug receiving cavity 76 and generally adjacent the bottom wall 80. The slots 110 and 112 are dimensioned to receive the connecting portions 106 and 108 of the solder tails 102 and 104 upon insertion of the shield 62 into the housing 68. Thus, as shown most clearly in FIG. 9, the solder tails 102 and 104 will extend generally parallel to the external surfaces of the side walls 72 and 74 of the housing 68 to enable the solder tails 102 and 104 to align with prespecified through holes in the circuit board. This mating of the solder tails 102 and 104 with the prespecified positions of the through holes in the circuit board can be achieved while still maintaining a lower overall profile for the entire jack 66. In particular, the lower profile is achieved by not having other portions of the shield 62 external to the housing 68 and by avoiding the need for the external outwardly extending locking tabs 48 which were depicted on the prior art jack 12 of FIG. 2.

Returning to FIG. 6, the footprint and profile enabled by the shield 62 of the subject invention may further be decreased by providing solder tails **102*a* and 104*a* as depicted in phantom lines, extending generally in the same plane as the side walls 86 and 88. The solder tails 102*a* and 104*a* may extend through corresponding slots in the bottom wall 80 of the housing 68. This configuration of the solder tails 102*a* and 104*a* may be employed in applications where the jack 66** is not required to conform to a prespecified footprint, and wherein a smaller footprint is possible and desirable.

The shield 62 shown in FIGS. 5–7 further comprises keys 114 and 116 extending from the top wall 84. In certain embodiments, the shield 62 may comprise only one of the keys 114 and 116 or neither key 114 and 116. These alternate embodiments may readily be achieved by eliminating one forming step in the stamping and forming of the shield 62 such that the key 114 or 116 may be disposed to lie generally in the same plane as the remainder of the top wall 84. Alternatively, the stamping of the shield 62 may be such that the key 114 and/or 116 may be stamped or cut entirely from the shield 62. The particular arrangement of keys 114 and 116 is selected in accordance with specified key grooves 58 on the prior art plug 50 to ensure that selected jacks 66 into which the shield 62 is inserted will be adapted to receive dedicated plugs 50.

The shield 62 is conveniently and easily slidably inserted at the front face 70 of the housing 68 on jack 66. The depth of insertion is controlled by the depth "a" of the bottom walls 90 and 92. More particularly, the depth of the bottom walls 90 and 92 corresponds to the distance between the front face 70 of the housing 68 and a stop 118 in the plug receiving cavity 76 thereof. The stop 118 will contact the bottom walls 90 and 92 to control the amount of insertion of the shield 62 into the plug receiving cavity 76 of the housing 68, and to ensure that the mating end 93 of the shield 62 generally aligns with the mating face of the housing 68.

The shield 62 is further provided with locking teeth 120 and 122 which define a dimension slightly greater than the internal dimension of the plug receiving cavity 76. The locking teeth 120 and 122 will engage the plastic material from which the housing 68 is molded to prevent withdrawal of the shield 62 from the housing 68.

Figure 8:
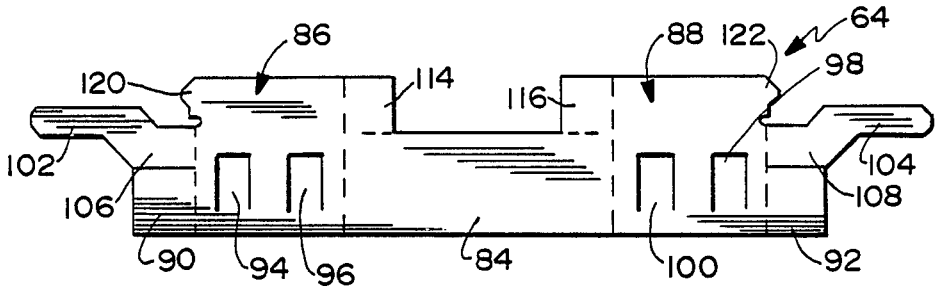
FIG. 8 is a top plan view of a stamped sheet of electrically conductive material for formation into the shield of FIGS. 5–7.

As noted above and as shown most clearly in FIGS. 9 and 10, the shield 62 is disposed substantially entirely internal to the housing 68 of the jack 66 thereby achieving a substantially lower profile while maintaining the same footprint as specified. The jack 66 shown in FIG. 9 could achieve a smaller footprint as well by merely extending the solder tails 102 and 104 in the same plane as the side walls 86 and 88 of the shield 62 with corresponding slots extending through the bottom wall 80 of the housing 68. In addition to achieving a lower profile and possibly a smaller footprint, the shield 62 achieves a very substantial savings in material as shown by comparing the blank 14 for forming the prior art shields in FIG. 3 with the blank 64 for forming the shield 62 of the subject invention as shown in FIG. 8.

Figure 11:
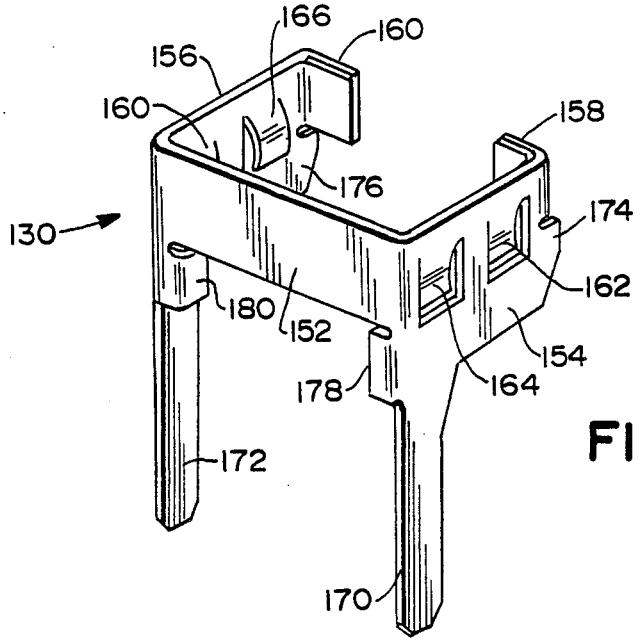
FIG. 11 is a perspective view of an alternate shield in accordance with the subject invention.
Figure 12:
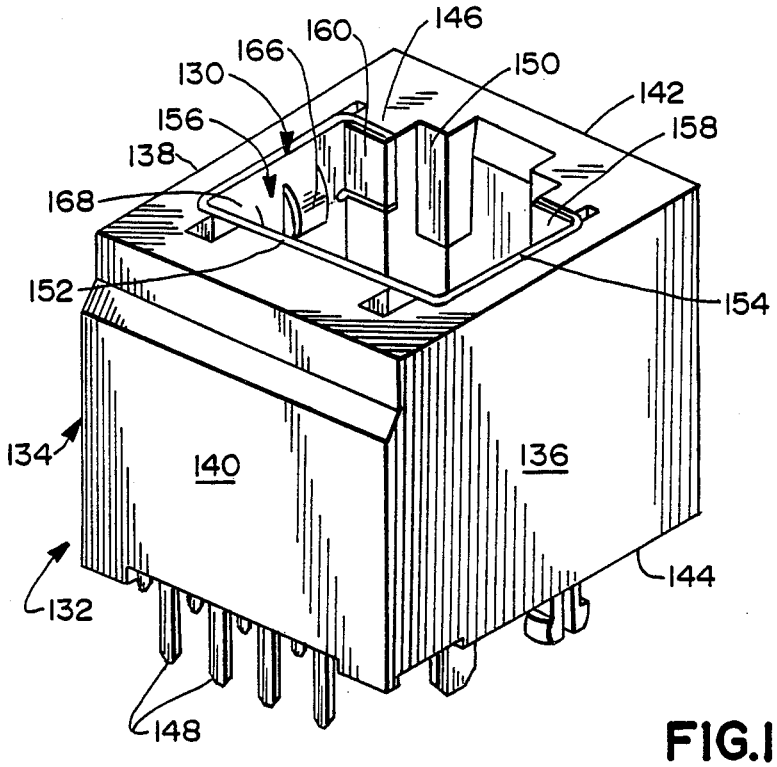
FIG. 12 is a perspective view of a top entry shielded jack including the shield of FIG. 11.

The shield of the subject invention may further be employed in a top entry jack. More particularly, a shield 130 is shown in FIG. 11 for incorporation into a top entry jack 132 as shown in FIG. 12. The jack 132 comprises a nonconductive housing 134 having opposed parallel side walls 136 and 138 and opposed parallel front and rear walls 140 and 142 respectively. The housing 134 further comprises a bottom 144 which is supportable on a circuit board, and an opposed top 146 which defines the mating face of the top entry jack 132. Terminals 148 are securely mounted in the housing 134 of the top entry jack 132. The housing 134 further comprises a plug receiving cavity 150 formed therein. A plug, such as the prior art shielded plug 50 shown in FIG. 4 can be inserted into the plug receiving cavity 150 such that the terminals 56 in the plug 50 achieve electrical contact with the terminals 148 in the top entry jack 132. Additionally, the shield 60 on the plug 50 of FIG. 4 will achieve electrical contact with the shield 130 of the top entry jack 132.

Referring to FIG. 11, the shield 130 is unitarily formed from a blank of metallic sheet material to comprise a front wall 152 a pair of opposed side walls 154 and 156 extending orthogonally from the front wall 152 and a pair of rear walls 158 and 160 extending toward one another from the side walls 154 and 156 respectively. The external dimensions defined by the front wall 152, the side walls 154 and 156 and the rear walls 158 and 160 enable the shield 130 to be slideably inserted into the plug receiving cavity 150 from top mating end 146 of the housing 134. The length of the shield 130 ensures that the shield will align with the mating face 146 of the housing 134. The side walls 154 and 156 of the shield 130 further are stamped and formed to define spring contacts 162-168 as shown in FIG. 11. The spring contacts 162-168 extend inwardly toward one another to achieve electrical contact with the shield on a plug inserted therein. The top entry jack 130 further comprises solder tails 170 and 172 extending generally in the same plane as the side walls 154 and 156 respectively. The solder tails 170 and 172 are disposed to extend through corresponding slots in the housing 134 of the top entry jack 132, and to extend to a location on the circuit board for making electrical contact with a ground thereon.

As with the previously described shield, the shield 130 for the top entry jack 132 comprises retaining teeth 174 and 176 for lockingly engaging the shield 130 in the housing 134. Additionally, the shield 130 comprises keys 178 and 180 which are selectively formed to achieve positive keying with associated plugs.

In summary, a low profile shielded jack is provided with the shield comprising peripheral shield walls dimensioned to enable the shield to be slidably inserted into the plug receiving cavity of the jack. The peripheral walls of the shield are stamped and formed to define inwardly extending spring contacts for engaging the shield on a plug mateable with the jack. The housing of the jack may comprise slots adjacent the mating face thereof for receiving the board contact means of the shield. In particular, the housing of the jack may comprise slots through which solder tails extend for contacting a ground on the circuit board. The disposition of the slots in the housing is selected in accordance with a specified footprint and circuit location on the board. The slots in the housing of the jack are further disposed to enable the shield to be inserted easily from the mating face of the jack. The shield is constructed to control the depth of insertion and to lockingly retain the shield in its position in the housing. The shield can be disposed substantially entirely at internal locations relative to the housing thereby substantially reducing the profile of the housing and enabling significant reductions in the amount of metal material required for the shield.

While the invention has been described with respect to a preferred embodiment, it is apparent that changes can be made without departing from the scope of the invention as defined by the appended claims.

I claim:

1. A low profile shielded jack for mounting to a circuit board and for receiving a plug having an external shield thereon, said jack comprising:

a nonconductive housing having a board mounting wall, a plug mating face and a plurality of peripheral walls, said peripheral walls defining a plug receiving cavity extending into the mating face of said housing for receiving the shielded plug, said housing further being formed to define a pair of slots in proximity to the board mounting wall thereof;

a plurality of terminals mounted in said housing for making electrical contact with corresponding terminals on the shielded plug mountable in the plug receiving cavity of said jack; and an electrically conductive shield unitarily formed to define peripheral shield walls disposed in the plug receiving cavity of said housing, said peripheral shield walls being disposed substantially in face to face contact with the peripheral walls of said housing defining the plug receiving cavity therein, said peripheral shield walls further comprising a mating end disposed generally in line with the mating face of said housing, a plurality of spring contacts unitarily formed with said peripheral shield walls and resiliently extending inwardly in the plug receiving cavity of said housing for electrically contacting the shield on the shielded plug insertable in said plug receiving cavity, said shield of said jack further comprising a pair of board contacts extending through the slots in said housing and beyond the board mounting wall of said housing for electrically contacting a ground on the circuit board to which said shielded jack is mountable.

2. A jack as in claim 1 wherein said housing comprises a pair of generally parallel side walls extending generally orthogonal to the board mounting wall of said housing, said slots extending into the side walls of said housing generally adjacent the board mounting wall thereof, the board contacts of said shield comprising a connecting portion extending through the slots in said housing and a ground portion extending generally parallel to the side walls of said housing and beyond the board mounting wall thereof.

3. A jack as in claim 1 wherein the plug receiving cavity in said housing is generally rectangular and wherein said peripheral shield walls of the shield comprises a pair of opposed generally parallel side walls and at least one wall extending unitarily therebetween, said board contact means extending generally parallel to the side walls of said shield.

4. A jack as in claim 3 wherein the board contacts are generally coplanar with the side walls of said shield.

5. A jack as in claim 1 wherein the housing comprises a stop in the plug receiving cavity thereof a selected distance from said mating face of said housing, one said peripheral shield wall having a length substantially equal to the selected distance, the peripheral shield wall being in abutting engagement with the stop of said housing for defining the depth of insertion of said shield into the plug receiving cavity of said housing.

6. A jack as in claim 1 wherein said shield further comprising a pair of selectively formable keys for corresponding with key grooves on selected plugs insertable in said jack.

7. A jack as in claim 1 wherein said shield comprises locking means for securely engaging the housing of said jack and preventing separation of said shield from said housing.

8. A low profile board mountable jack for mating with a generally rectangular plug having a plurality of terminals therein and having an external shield, said jack comprising:

a generally rectangular housing having a bottom wall for mounting to a circuit board, a pair of opposed side walls extending generally orthogonally from said bottom wall and a top wall extending between the side walls and generally parallel to the bottom wall, a mating face extending generally orthogonal to the bottom wall and the side walls, said bottom wall, said side walls and said top wall being generally spaced from one another and defining a generally rectalinear plug receiving cavity extending into the mating face of said housing, a pair of contact receiving slots extending into the mating face generally adjacent the bottom wall of said housing;

a plurality of terminals mounted in said housing for electrically engaging the terminals of said plug upon insertion of said plug into said plug receiving cavity of said housing; and a shield disposed in the plug receiving cavity of said housing, said shield comprising a bottom wall disposed in face to face contact with the bottom wall of said housing, a pair of opposed parallel side walls disposed in face to face contact with the side walls of said housing and a top wall disposed in face to face contact with the top wall of said housing, said shield comprising a mating end disposed generally in line with the mating face of said housing, a plurality of inwardly directed spring contacts formed in the walls of said shield and extending inwardly a distance to achieve electrical contact with the external shield on the plug mountable in the plug receiving cavity of said jack housing, said shield further comprising board contact means extending through the slots in the housing for electrically engaging a ground on the board.

9. A jack as in claim 8 wherein the plug receiving cavity of said housing comprises a stop unitarily formed therein, said stop being disposed to achieve abutting contact with the shield for controlling the position of the mating end of the shield relative to the mating face of said housing.

10. A jack as in claim 8 wherein the shield further comprises at least one retaining tooth for locking engagement with the housing.

11. A jack as in claim 8 wherein the slots extend into the mating face of said housing generally at locations thereon where the side walls of said housing meet the bottom walls thereof, the board contact means of said shield being formed to extend through said slots to locations external of said housing, the portions of said board contact means external of said housing being generally parallel to the side walls thereof.

12. A jack as in claim 11 wherein the portions of said board contact means disposed in the slots are generally in the same plane as the bottom wall of the shield.

13. A jack as in claim 11 wherein the portions of board contact means of said shield which are disposed external of said housing are disposed externally of said side walls of said housing.

14. A jack as in claim 8 wherein said shield comprises keying tabs for achieving positive keying with the plug.

* * * * *